US006089886A

United States Patent [19]

Mareno

[11] Patent Number: 6,089,886

[45] **Date of Patent: *Jul. 18, 2000**

[54] SWIVELING ELECTRICAL PLUG ASSEMBLY

[75] Inventor: Jason D. Mareno, Raleigh, N.C.

[73] Assignee: Ericsson, Inc., Research Triangle Park, N.C.

[ * ] Notice: This patent is subject to a terminal disclaimer.

[21] Appl. No.: 09/447,376

[22] Filed: Nov. 23, 1999

Related U.S. Application Data

[63] Continuation of application No. 09/151,148, Sep. 10, 1998.

[51] Int. Cl.[7] ..... H01R 13/44

[52] U.S. Cl. ..... 439/131; 439/518; 439/174

[58] Field of Search ..... 439/131, 172, 439/173, 174, 52, 518, 956

[56] References Cited

U.S. PATENT DOCUMENTS

| | | | |
|---|---|---|---|
| 4,013,330 | 3/1977 | Hugly . | |
| 4,973,827 | 11/1990 | Nozaki | 439/172 |
| 4,997,381 | 3/1991 | Oh | 439/172 |
| 5,613,863 | 3/1997 | Klaus et al. | 439/131 |
| 5,634,806 | 6/1997 | Hahn | 439/172 |
| 5,713,749 | 2/1998 | Wu | 439/173 |
| 5,967,807 | 10/1999 | Wu | 439/131 |

*Primary Examiner*—Renee Luebke
*Assistant Examiner*—T. C. Patel
*Attorney, Agent, or Firm*—Coats & Bennett, PLLC

[57] ABSTRACT

An electrical plug assembly includes a secondary plug assembly which releasably mates with a rotatable default plug assembly. The default plug assembly is moveable between a storage position and a deployed position and includes a plurality of default prongs of a first physical configuration. A casing associated with the default plug assembly includes a recess for receiving the default plug assembly in the storage position. The distinct secondary plug assembly includes a main body and a plurality of secondary prongs of a second physical configuration extending from the front of the main body. The secondary plug assembly attaches to the default prongs to assume a mated position, such as by sliding the secondary plug assembly rearwardly over the default prongs. A suitable latch and catch arrangement is used to releasably secure the secondary plug assembly to the default plug assembly. Preferably, the only connection between the secondary plug assembly and the casing is via the default plug assembly. In the mated position, the secondary plug assembly rotates with the default prongs and the secondary prongs are in electrical contact with the default prongs. The recess in the casing is preferably of a size and shape to substantially contain the secondary plug assembly in the mated position when the default prongs are rotated to the storage position. Accordingly, the secondary plug assembly may remain installed over the default prongs even when the default prongs are moved to the storage position, thereby lessening the likelihood that the secondary plug assembly will be lost and making it more convenient for carrying with the secondary plug assembly attached.

18 Claims, 9 Drawing Sheets

SWIVELING ELECTRICAL PLUG ASSEMBLY

This is a continuation of application No. 09/151,148, filed Sep. 10, 1998, still pending.

FIELD OF THE INVENTION

The present invention relates generally to electrical plug assemblies, and more particularly to a swiveling multiple function electrical plug assembly.

BACKGROUND OF THE INVENTION

With the emergence of global travel as a daily occurrence, there are many occasions when an electrically-operated device, such as a battery charger, phone, or computer, is required to draw power from a commercial power source. Such commercial power is typically delivered via a plug mated to a wall receptacle or extension cord receptacle. Unfortunately, there is no single standard for electrical plug/receptacle size, shape, position or number of prongs and there are a wide variety of receptacle configurations in use worldwide. This variety of differing receptacle configurations poses a problem to both manufacturers who sell equivalent products into various parts of the world and to world travelers that need to take electrical devices with them.

Several approaches have be taken to deal with this situation. One approach is to employ a series of distinct adapters which are male on one side and female on the other. When desired, a particular adapter is selected and attached to the electrical primary plug prongs of the device. Then the adapter male end is plugged into the power outlet receptacle. This approach suffers from at least two drawbacks. First, the separate adapter creates an additional item that must be carried by the user and is frequently misplaced. Second, many devices have been designed with a plug or prongs which rotate or fold into the device's casing. For example, some rechargeable flashlights include prongs which can be rotated from a storage position into a deployed position extending out from the body of the flashlight and plugged directly into a wall receptacle or extension cord. For such devices, the adapters are not freely rotatable with the primary prongs, thereby limiting ease of use.

Another approach, disclosed in U.S. Pat. No. 5,713,749 to Wu, utilizes a plurality of separate prong sets having different prong configurations, one of which must be installed into the device for the device to function. Once installed, the prong sets are generally rotatable. However, the Wu approach is complicated to manufacture and requires a significant degree of manual dexterity to install and remove the adapters. Another approach, disclosed in U.S. Pat. No. 4,997,381 to Oh, utilizes a pair of interconnected rotating prong sets which have different prong configurations. The two sets of prongs may be interlocked so as to rotate together. When not desired for use, the prongs may be rotated to a storage position. The approach of Oh is mechanically complicated and difficult to manufacture.

While the approaches of Wu and Oh address one or more of the problems caused by the variety of receptacle configurations, they are not completely satisfactory, if for no other reason than their complexity. Thus, there remains a need for a simple electrical plug assembly designed for use with a plurality of different receptacle configurations which allows for rotating prongs and which is easy to manufacture and use.

SUMMARY OF THE INVENTION

The electrical plug assembly of the present invention includes a secondary plug assembly which releasably mate's with a rotatable default plug assembly. The default plug assembly is moveable between a storage position and a deployed position and typically includes an axle and a plurality of default prongs of a first physical configuration secured thereto. A casing associated with the default plug assembly typically includes an electrical circuit adapted to condition electrical power and a recess for receiving the default plug assembly in the storage position. When the default plug assembly is in the deployed position, the default prongs are in electrical communication with the electrical circuit.

The distinct secondary plug assembly includes a main body and a plurality of secondary prongs of a second physical configuration extending from the front of the main body. This second physical configuration may include a change to spacing between prongs, a change in physical dimensions of each prong, a change in number of prongs, or other change to the characteristics of the prongs, or any combination thereof. The main body houses a plurality of bridging contacts adapted to slidably receive the default prongs and has a plurality of associated entry holes on the rear of the main body for entry of the default prongs.

The secondary plug assembly attaches to the default prongs to assume a mated position, such as by sliding the secondary plug assembly rearwardly over the default prongs so that the default prongs extend through the entry holes and into the secondary plug assembly. A suitable latch and catch arrangement may be used to releasably secure the secondary plug assembly to the default plug assembly. Thus, the secondary plug assembly may be quickly and easily installed over the default prongs or quickly and easily removed therefrom. Preferably, the only connection between the secondary plug assembly and the casing is via the default plug assembly.

In the mated position, the secondary plug assembly rotates with the default prongs and the secondary prongs are in electrical contact with the default prongs. Thus, the secondary prongs electrically communicate with the electrical circuit via the default prongs when the secondary plug assembly is in the mated position and the default plug assembly is in the deployed position.

The recess in the casing is preferably of a size and shape to substantially, and more preferably completely, contain the secondary plug assembly in the mated position when the default prongs are rotated to the storage position with the secondary plug assembly attached thereto.

The swiveling electrical plug assembly of the present invention is simple to build and operate. Whether the secondary plug assembly is attached or not, the exposed prongs associated with the casing are rotatable between a storage position and a deployed position. Further, the secondary plug assembly may remain installed over the default prongs even when the default prongs are moved to the storage position, thereby lessening the likelihood that the secondary plug assembly will be lost and making it more convenient for carrying with the secondary plug assembly attached.

DETAILED DESCRIPTION

Figure 1:
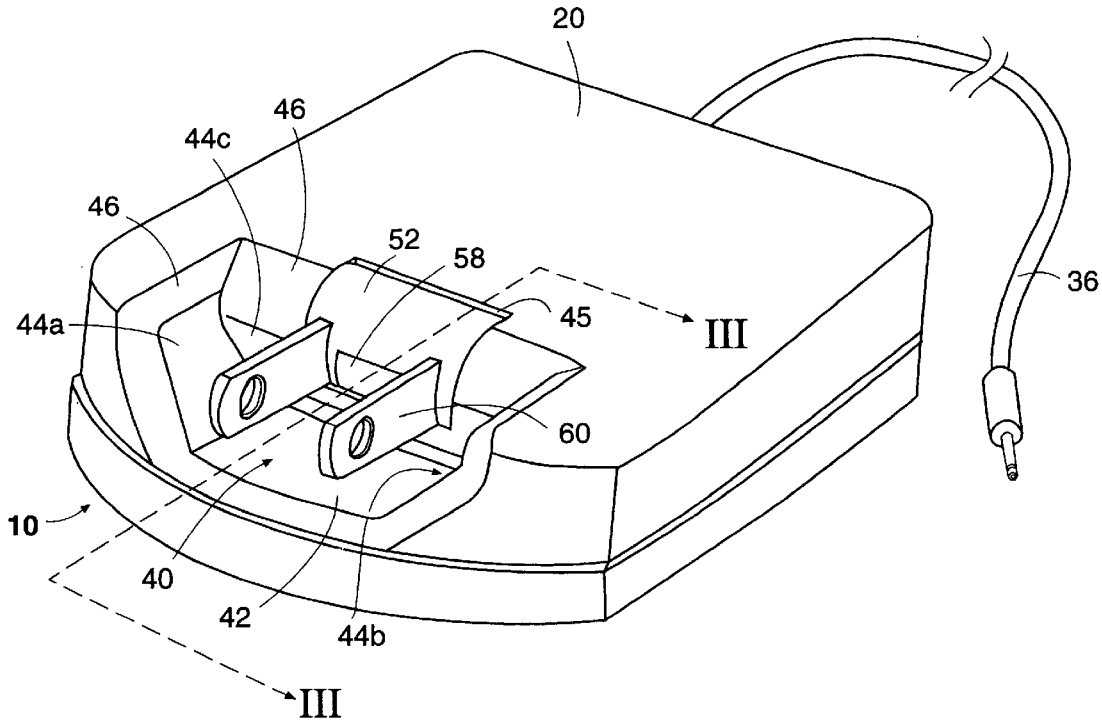
FIGS. 1(*a*) and (*b*) are a perspective view of the bottom of an electrical device incorporating one embodiment of the present invention with the default plug assembly in the storage position (a) and in the deployed position (b).
Figure 1:
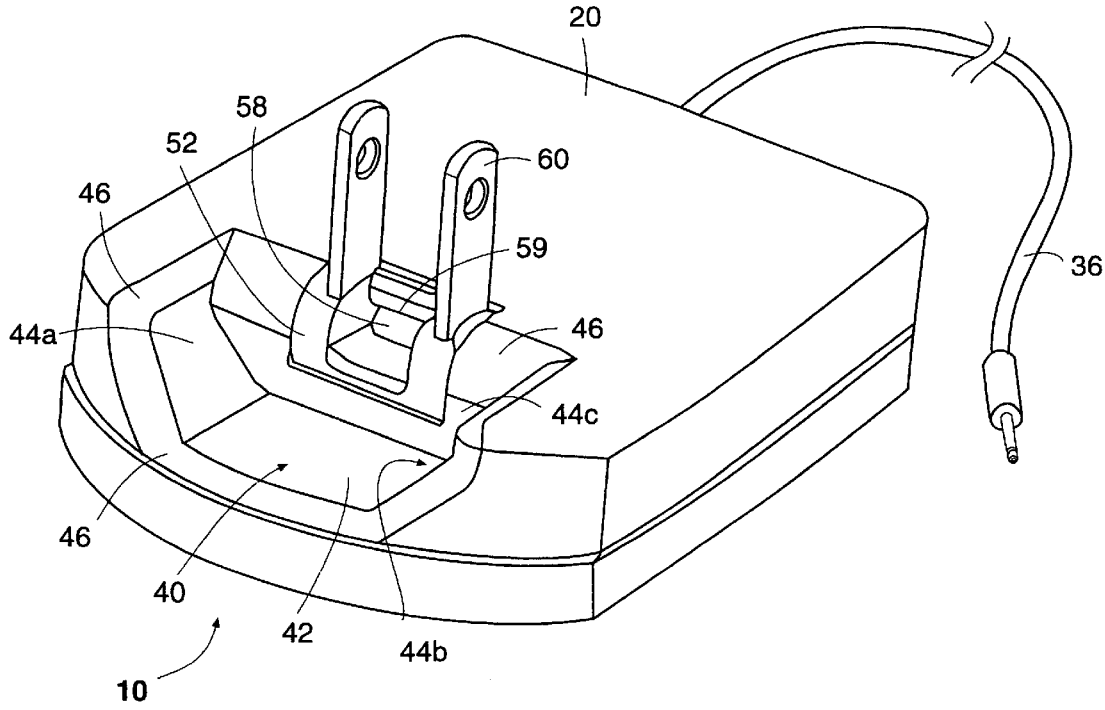
Figure 2:
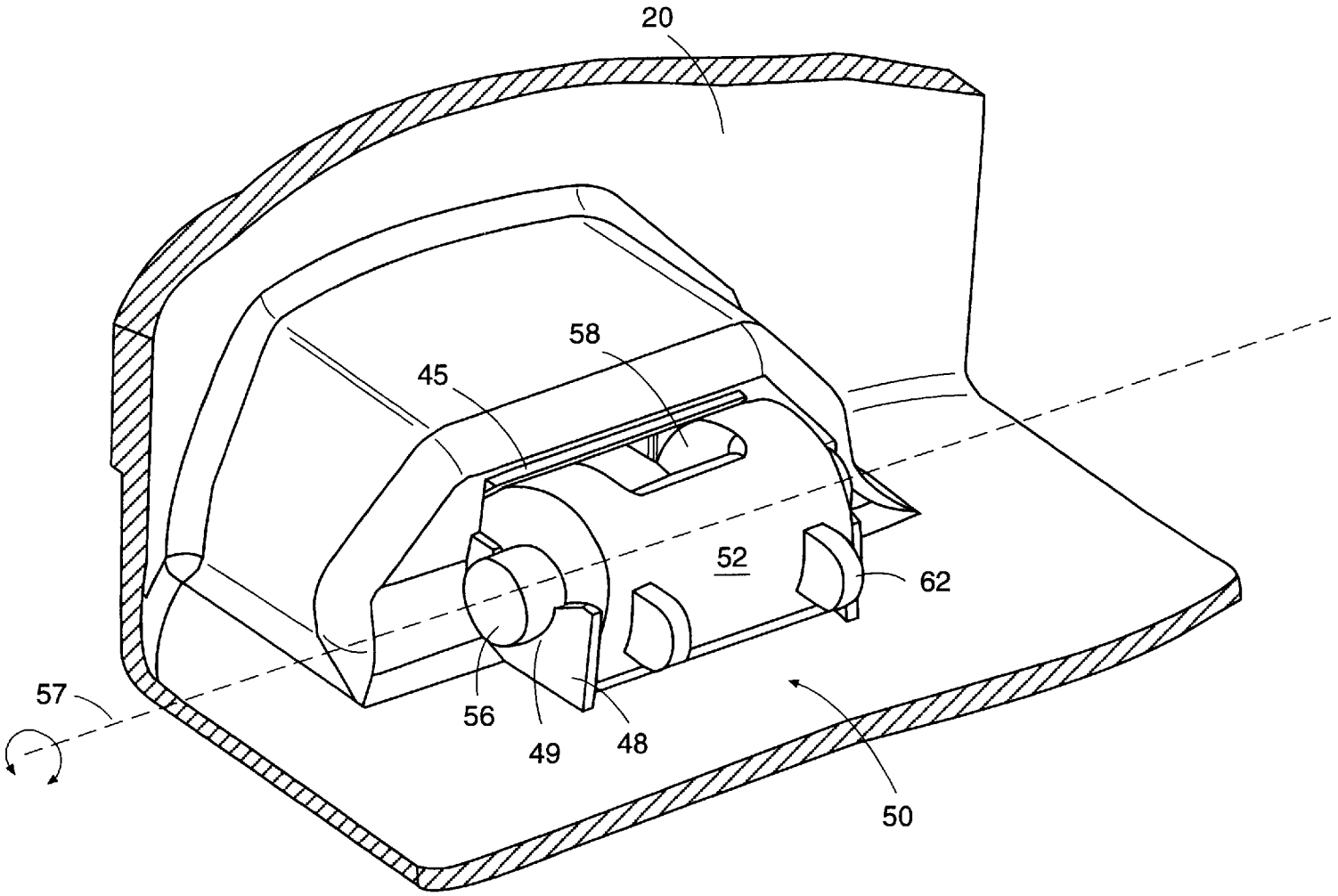
FIG. 2 is a partial perspective interior view of the device of FIG. 1(*a*) with the default plug assembly in the storage position.
Figure 3:
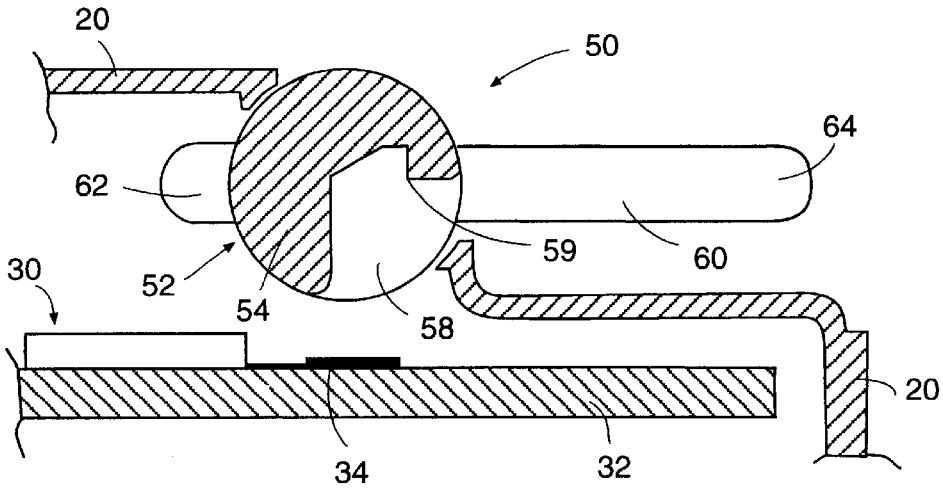
FIGS. 3(*a*) and (*b*) are a partial sectional view along line III—III of FIG. 1 with the default plug assembly in the storage position (a) and in the deployed position (b).
Figure 3:
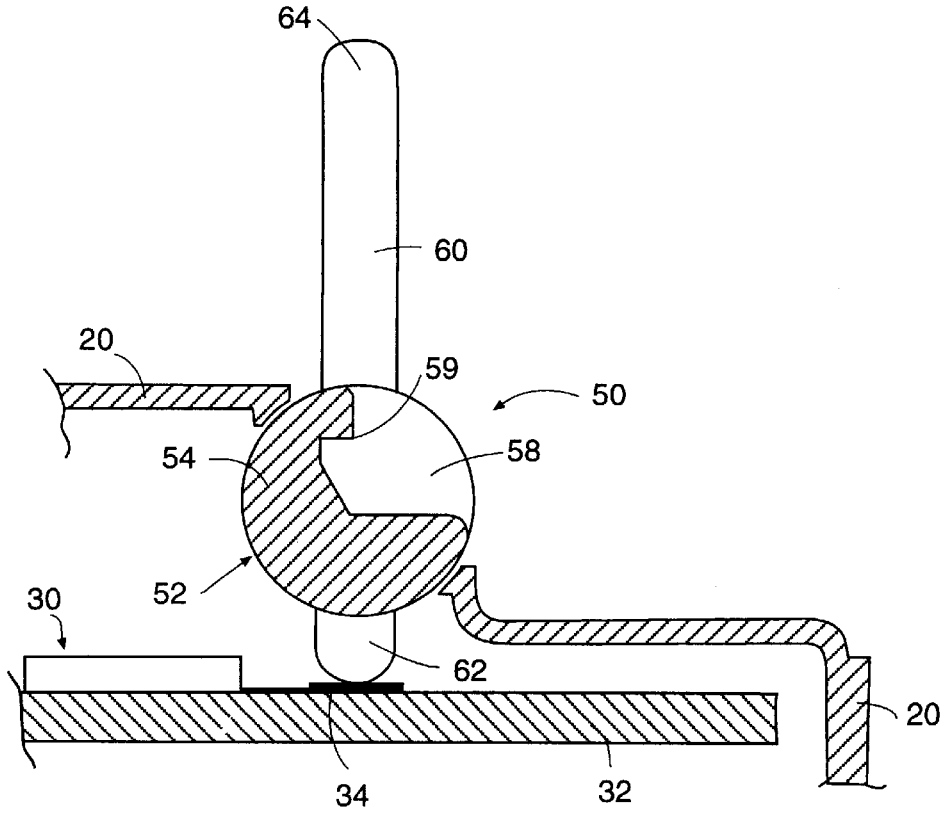

The electrical plug assembly 10 of the present invention includes a casing 20, a default plug assembly 50, and a secondary plug assembly 70. Referring to FIGS. 1–3, the casing 20 encloses at least a portion, and typically the entire, electronics 30 of the electronic device. The electronics 30 may take a wide variety of forms but typically include circuits suitable for handling incoming power from a commercial power receptacle. For example, the electronics 30 include a switching power supply for a power converter. The electronics 30 are typically arrayed on a printed circuit board 32. For some devices, there may be an outlet cable 36 attached to the casing 20 and in electrical communication with the electronics 30.

The casing 20 includes a recess 40, typically on an underneath end portion thereof. The recess 40 preferably has a top 42, sidewalls 44*a–c*, and a circumferential curved edge 46. The center sidewall 44*c* should have an opening 45 through which a portion of the default plug assembly 50 protrudes. As best seen in FIG. 2, on the interior of casing 20 are a plurality of flanges 48 extending from the center sidewall 44*c* and disposed on opposing sides of the opening 45. Each flange 48 includes a generally semi-circular notch 49 in a center portion thereof.

Referring to FIGS. 1–3, the default plug assembly 50 includes an axle 52 and a plurality of default prongs 60. The axle 52 includes a center section 54 of generally cylindrical shape and an ear 56 on each end of the center section 54. The longitudinal axis 57 of the center section 54, through the ears 56, defines an axis of rotation 57. The center section 54 includes a cutout portion defining a catch passage 58 and an associated lip 59 which are best seen in FIG. 3. For purposes of illustration, the default prongs 60 are shown as being of a blade type, such as the common United States 120 VAC blade prongs; but the default prongs 60 may be of any type well known in the art. The default prongs 60 are securely attached to the axle 52, and may be mold formed therewith. An end portion of each default 60 prong extends out one side of the axle 52, with the majority of the default prong 60 extending out the other side of the axle 52. For clarity, the end of each default prong 60 nearest the axle 52 will be referred to as the axle end 62 and the opposite end of each prong 60 will be referred to as the insert end 64.

The default plug assembly 50 is rotatably mounted to the casing 20 and a portion of the default plug assembly 50, including at least a portion of the default prong 60, extends through the opening 45 in the center sidewall 44*c* of the recess 40. The ears 56 of the axle 52 are engaged by the corresponding notches 49 of the flanges 48, allowing the default plug assembly 50 to rotate about the axis 57 of the axle 52. The default plug assembly 50 rotates between a storage position, shown in FIG. 1(*a*), and a deployed position, shown in FIG. 1(*b*). As shown in FIG. 3(*b*), when the default plug assembly 50 is rotated into the deployed position, the axle ends 62 of the default prongs 60 come into contact with corresponding contacts 34 on the printed circuit board 32 so as to complete an electrical pathway from the insert ends 64 of the default prongs 60 to the electronics 30 of the device. Alternatively, the axle ends 62 of the default prongs 60 may be engaged by any other form of electrical contact well known in the art. Preferably, some detent or other releasable retention means (not shown) engages the default prongs 60 and/or the ears 56 of the default plug assembly 50 so as to help retain the default plug assembly 50 in the deployed and/or storage position.

Figure 4:
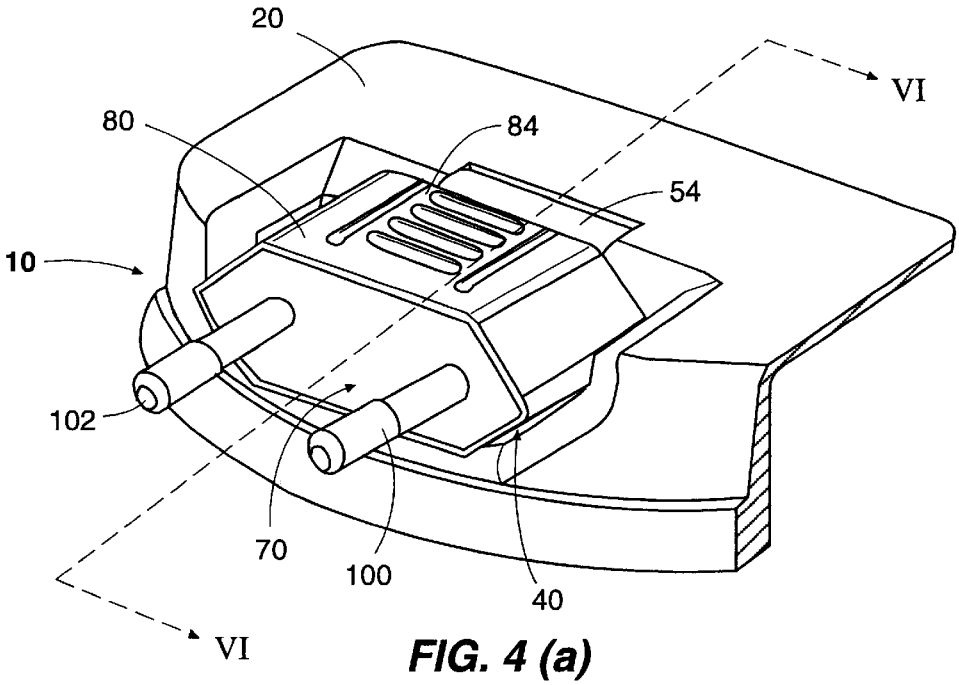
FIGS. 4(*a*) and (*b*) are a partial perspective view of the device of FIG. 1 with the secondary plug assembly attached in the mated position and the secondary plug assembly in the storage position (a) and in the deployed position (b).
Figure 4:
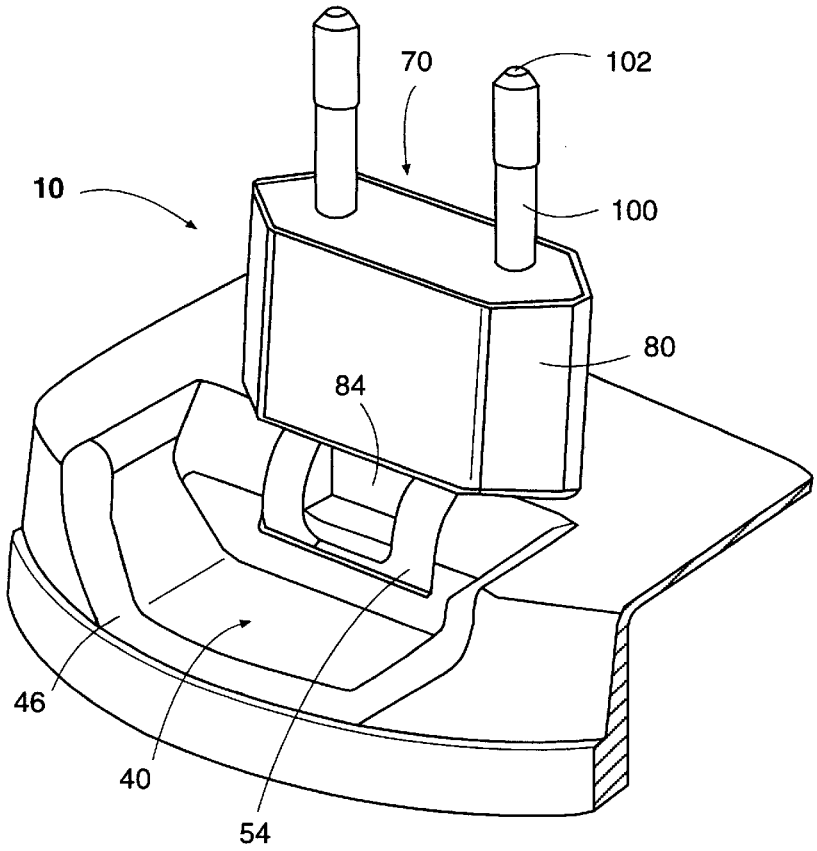
Figure 5:
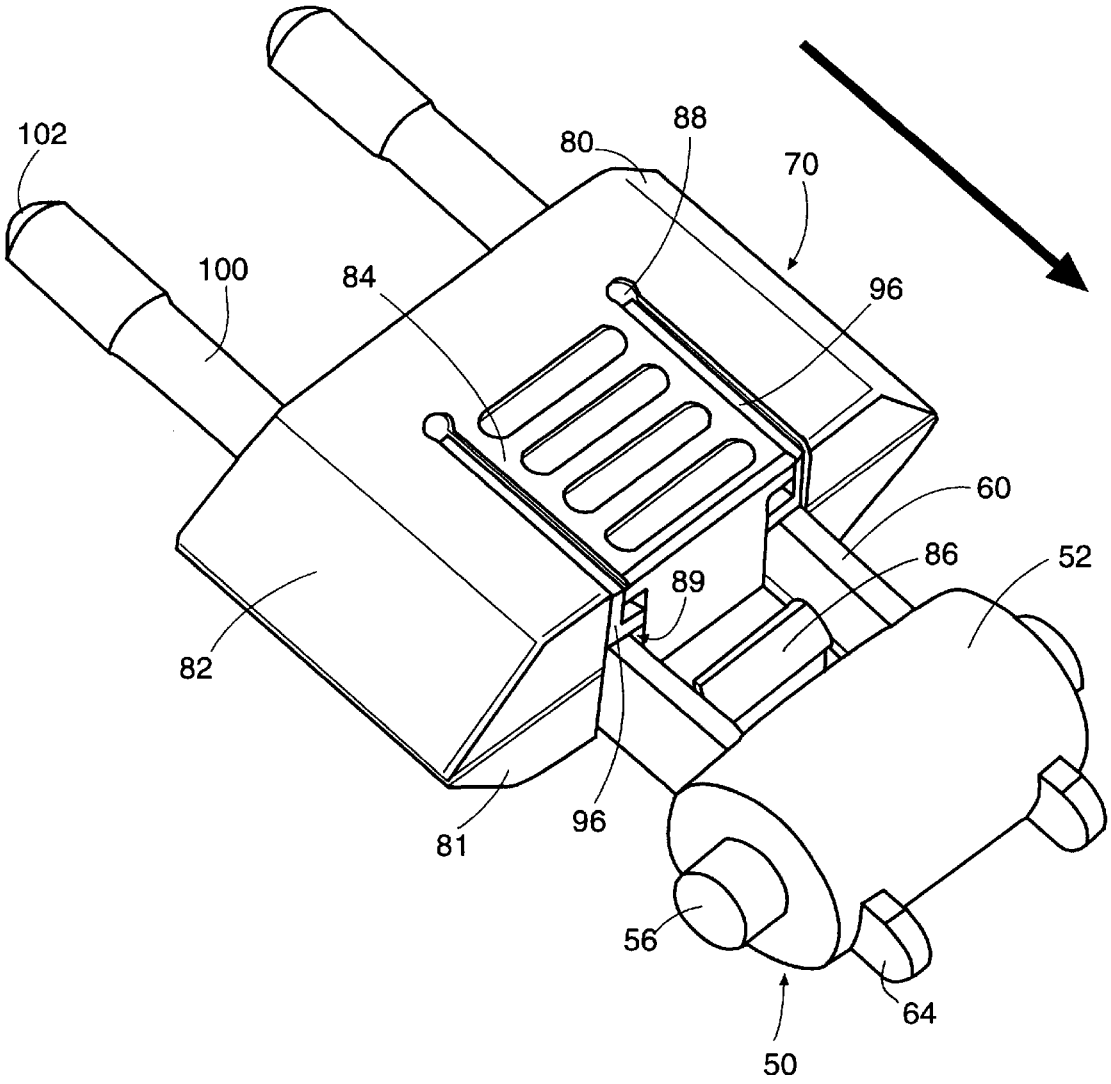
FIG. 5 is a partial perspective view of a secondary plug assembly being moved to the mated position on the default plug assembly.
Figure 6:
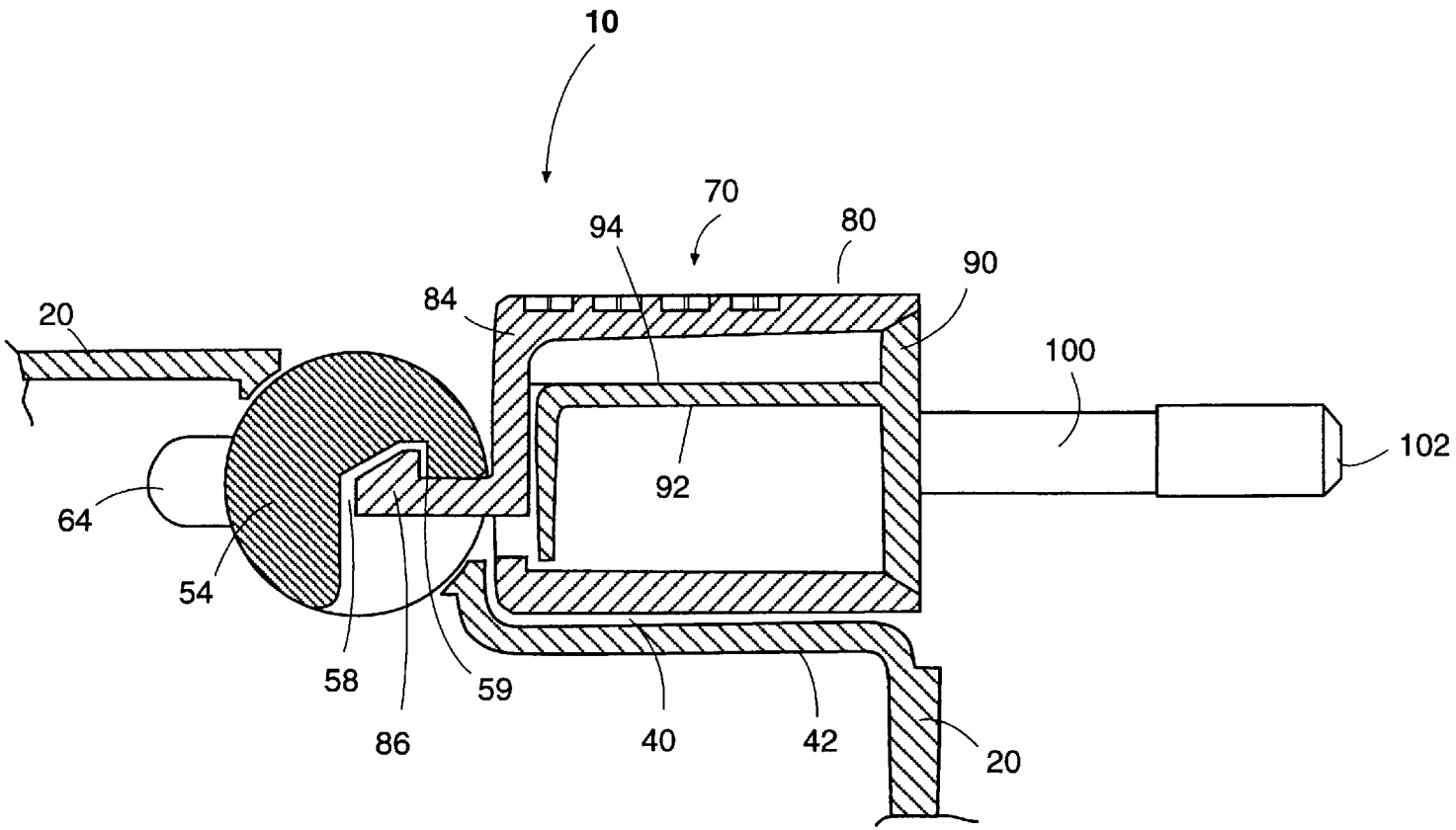
FIG. 6 is a partial sectional view along line VI—VI of FIG. 4(*a*) with the secondary plug assembly in the storage position.

The secondary plug assembly 70 includes a shell 80, an insert 90, and a plurality of secondary prongs 100. The shell 80 may be of any common shape suitable for accommodating a standard power plug configuration. The recess 40 of the casing 20 should be of a shape corresponding to the shell 80. In FIGS. 4–6, the shell 80 is shown as an elongated hexagon. The shell 80 includes a lock bar 84 on its lower portion 82 having a latch 86 on one end and attached in cantilevered fashion to the main portion of the shell 80 on the other. The lock bar 84 should be bounded on its sides by slots 88 to allow freer movement of the lock bar 84. The latch 86 of the lock bar 84 is configured so as fit into the catch passage 58 of the default plug assembly 50 and engage the lip 59 when the secondary plug assembly 70 is in the mated position.

Figure 7:
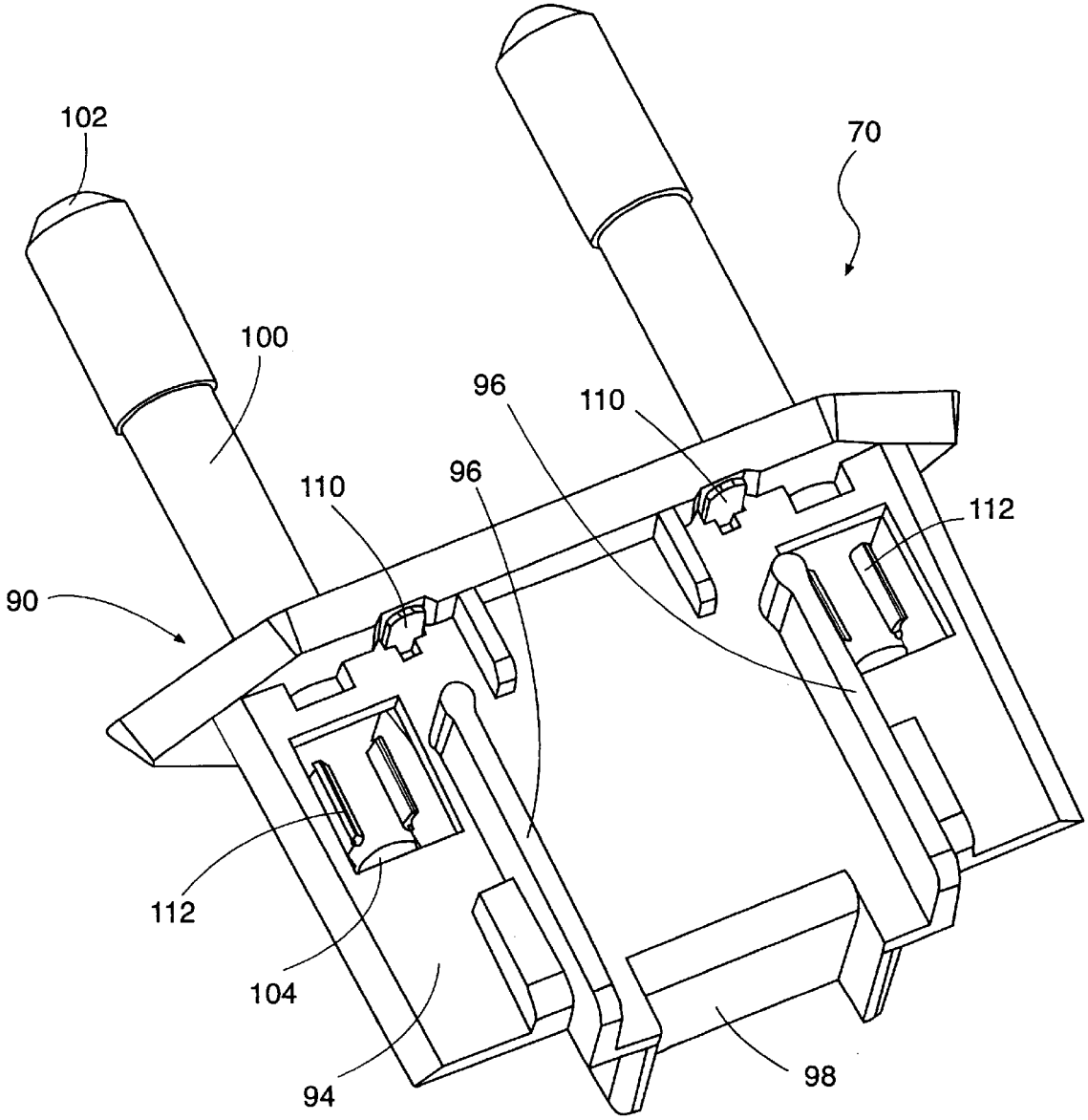
FIG. 7 is a perspective view from below of a secondary plug assembly with the shell removed.
Figure 8:
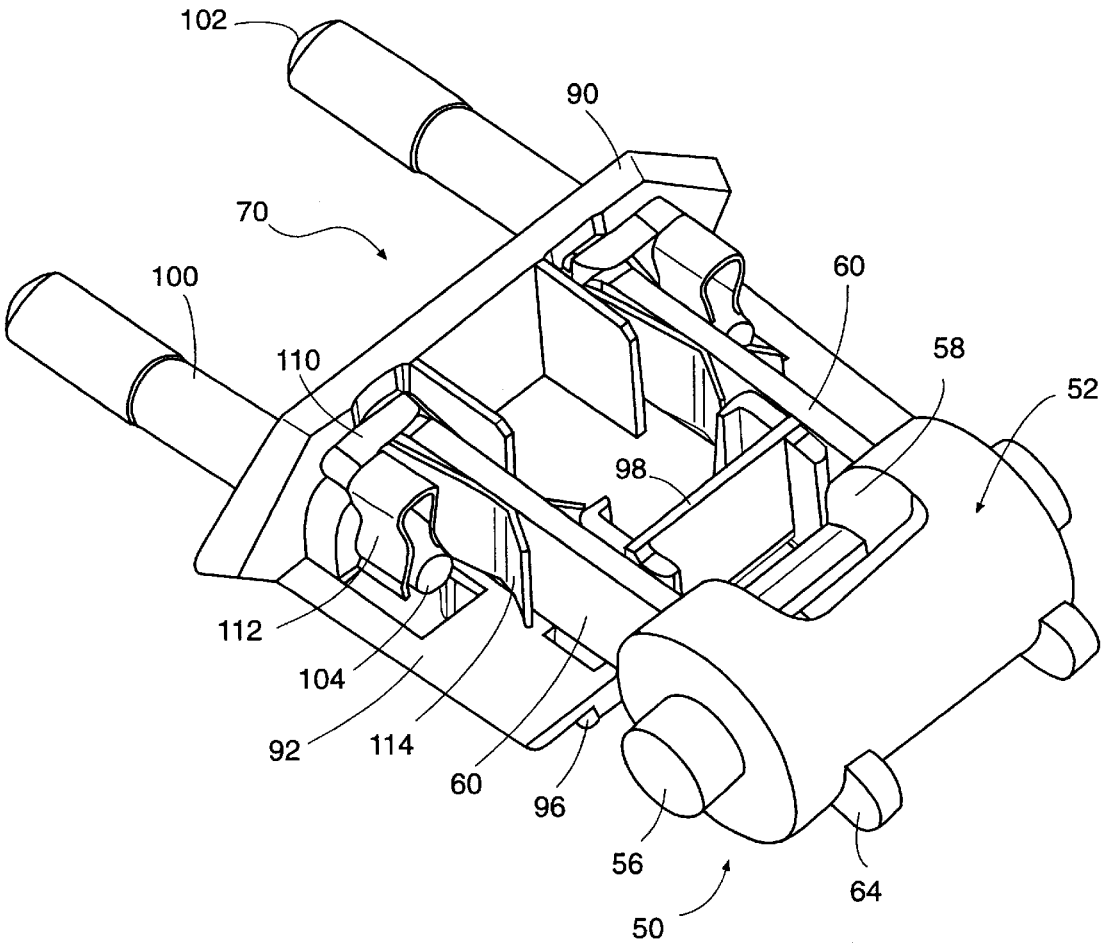
FIG. 8 is a perspective view from above of a default plug assembly and a secondary plug assembly in the mated position with the shell of the secondary plug assembly removed.

Referring to FIGS. 7–8, the insert 90 has an upper surface 92 and a lower surface 94 and includes a plurality of ribs 96 on the lower surface 94 and a plurality of bridging contacts 110 disposed on the upper surface 92. The ribs 96 are positioned so as to be aligned with the corresponding slots 88 on the shell 80 and are of sufficient size so as to just fill the slots 88 when the insert 90 is joined to the shell 80. The upper surface 92 preferably includes one or more guides 98 disposed between the bridging contacts 110 so as to keep bridging contacts 110 separate.

For purposes of illustration, the secondary prongs 100 are shown as being of a round type, such as the common in continental Europe; but the secondary prongs 100 may be of any type well known in the art. The secondary prongs 100 are securely attached to the insert 90, and may be mold formed therewith. The end of each secondary prong 100 protruding farthest from the insert 90 is referred to as the exterior end 102 and the opposite end is referred to as the interior end 104.

Figure 9:
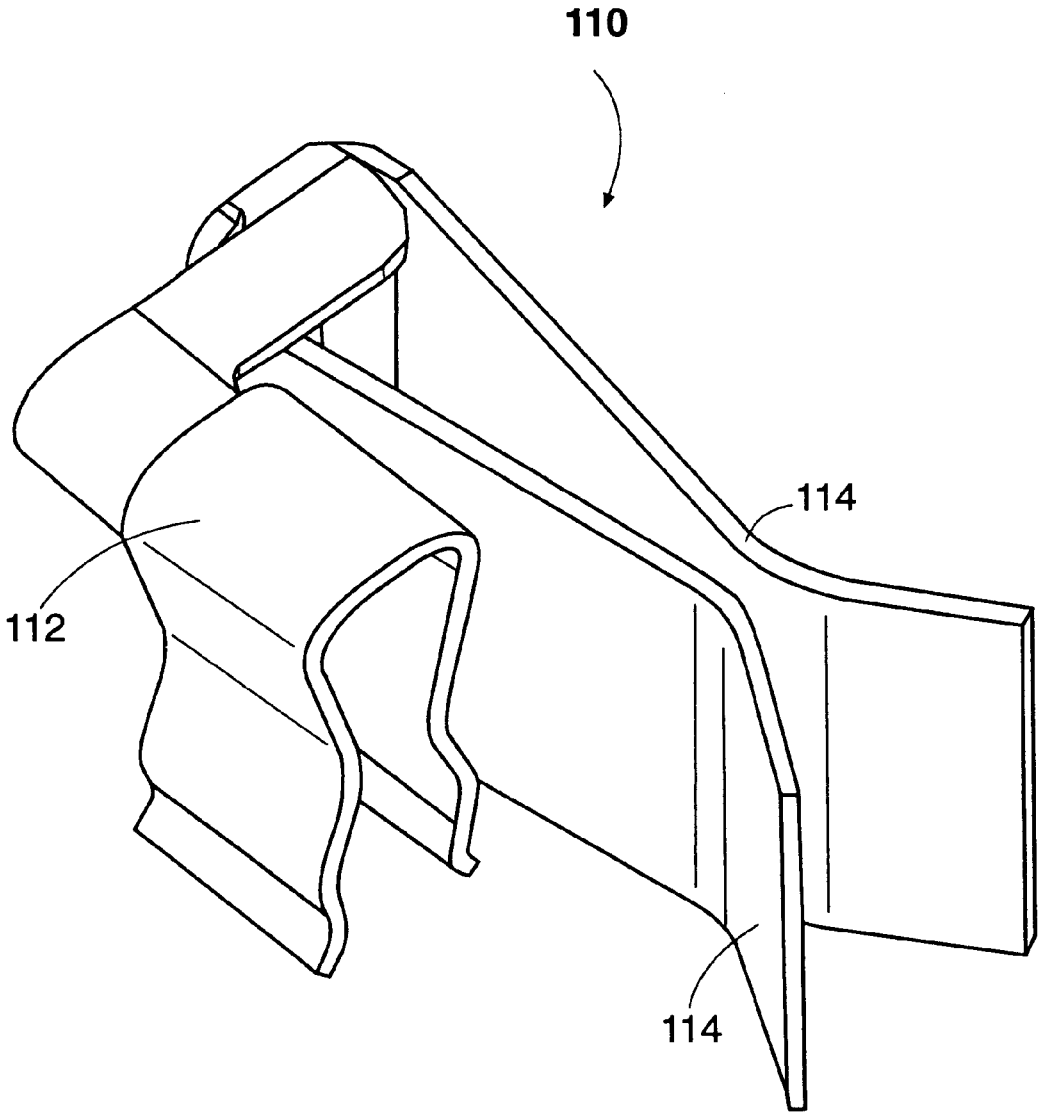
FIG. 9 is a perspective view of one embodiment of bridging contacts suitable for use with the secondary plug assembly of the present invention.

Referring to FIGS. 7–9, the bridging contacts 110 preferably include a snap clip portion 112 electrically connected to a pair of squeeze fingers 114. The snap clip portion 112 is designed to snap fit over the interior end 104 of a secondary prong 100. The squeeze fingers 114 are designed to slidably engage the insert end 64 of a default prong 60.

To assemble the secondary plug assembly 70, the insert 90 is slid into the shell 80. Preferably, the ribs 96 of the insert 90 are of such height as to slightly bow the shell 80. When fully inserted, the ribs 96 will fit into the slots 88, allowing the shell 80 to unbow and thereby preventing the insert 90 from being detached from the shell 80. When the secondary plug assembly 70 is assembled, the secondary prongs 100 extend out the front of the secondary plug assembly 70 and the latch 86 extends out the rear. On the rear surface of the shell 80 are entry holes 89 disposed on either side of the latch 86. These entry holes 89 spaced and configured so as to be able to accept the default prongs 60.

To use the secondary plug assembly 70, the secondary plug assembly 70 is installed onto the default prongs 60. The insert ends 64 of the default prongs 60 fit into the entry holes 89 and slide into the squeeze fingers 114 of the corresponding bridging contact 110 internal to the secondary plug assembly 70. The force required to insert the default prongs 60 is preferably approximately the same as that required to insert a common lamp plug into a common wall outlet. As the default prongs 60 approach being fully inserted into the secondary plug assembly 70, the latch 86 is directed into the catch passage 58 of the axle 52. When the secondary plug assembly 70 reaches the mated position, the latch 86 is caught by the lip 59 of the axle 52 so as to secure the secondary plug assembly 70 to the default plug assembly 50. In the mated position, the secondary plug assembly 70 is supported by, and rotates with, the default plug assembly 50 (with respect to the casing 20). For instance, the secondary plug assembly 70 rotates between a deployed position and a storage position when the default plug assembly 50 is rotated to between the deployed position and the storage position, respectively. In the storage position, the shell 80 rests substantially, and preferably totally, within the recess 40. In the deployed position, the secondary plug assembly 70 is supported by the default plug assembly 50 and is not connected to the casing 20 except through the default plug assembly 50. Preferably, the detent or other releasable retention means (not shown) associated with the default plug assembly 50 likewise helps retain the secondary plug assembly 70 in the deployed and/or storage position.

With the secondary plug assembly 70 in the mated position, there is an electrical path from the exterior end 102 of the secondary prong 100, to the interior end 104 of the secondary prong 100, to the bridging contact 110 to the insert end 64 of the default prong 60, to the axle end 62 of the default prong 60. If the default plug assembly 50 is in the deployed position, this electrical path extends through the contacts 34 to the electronics 30.

When the secondary plug assembly 70 is no long er needed, such as when the user returns to the user's home country, the secondary plug assembly 70 may be removed from the default plug assembly 50. To do so, the user merely need press on the lock bar 84, thereby disengaging the latch 86 from the lip 59, and pull on the secondary plug assembly 70 until the default prongs 60 are fully pulled-out from the entry holes 89. The secondary plug assembly 70 is then fully separated from the casing 20 and associated default plug assembly 50.

By way of a non-limiting example, the swiveling electric plug assembly 10 of the present invention may use default prong 60 which conform to the common United States standard NEMA 5-15 and secondary prong 100 which conform to the common European standard CEE 7/16 "Europlug." However, these plug configurations may vary depending on the application. Further, there are preferably a plurality of secondary plug assemblies 70 having different secondary prong 100 configurations, each secondary plug assembly 70 being suitable for use in one or more countries.

The shell 80, insert 90, axle 52, and casing 20 may be made from any suitable non-conductive material, such as ceramics or plastics, but are preferably injection molded from a polycarbonate/ABS blend or polyvinylcholride. The shell 80 may be formed in one piece or may be formed in multiple parts, such as an upper portion 81 and a lower portion 82, and joined together using any known technique such as ultrasonic welding, snap fitting, or the like. The bridging contacts 110 should be electrically conductive and may be formed from any suitable spring material, such as stainless steel, beryllium copper, phosphor bronze, or the like. The default prongs 60 and the secondary prongs 100 should likewise be made from any suitable conductive material such as phosphor bronze, nickel coated brass, or the like. It may be desirable for the secondary prongs 100 to include a conductive core which is partially covered by a non-conductive material, as is well known in the art, so as to help prevent unwelcome shocks to users.

The swiveling electrical plug assembly 10 of the present invention is simple to build and operate. Whether the secondary plug assembly 70 is attached or not, the exposed prongs associated with the casing 20 are rotatable between a storage position and a deployed position. The secondary plug assembly 70 may be quickly and easily installed over the default prongs 60 or quickly and easily removed therefrom. Further, the secondary plug assembly 70 may remain installed over the default prongs 60 even when the default prongs 60 are moved to the storage position, thereby lessening the likelihood that the secondary plug assembly 70 will be lost and making it more convenient for carrying with the secondary plug assembly 70 in place.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An electrical plug assembly, comprising a) a casing having a recess;

b) a default plug assembly including a plurality of default prongs, said default plug assembly rotatably mounted to said casing and moveable into said recess;

c) a secondary plug assembly repeatably removably attachable to said default prongs and rotatable with said default plug assembly when attached thereto; said secondary plug assembly having a main body;

d) said main body of said secondary plug assembly moveable into said recess when attached to said default plug assembly.

2. The assembly of claim 1 wherein said secondary plug assembly includes a plurality of secondary prongs having a different configuration than said default prongs.

3. The assembly of claim 2 wherein said secondary plug assembly includes a plurality of bridging contacts connected to said secondary prongs and adapted to slidably receive said default prongs.

4. The assembly of claim 1 wherein said casing further includes an electrical circuit in selective communication with said default prongs and adapted to condition power received at said default prongs.

5. The assembly of claim 1 wherein said secondary plug assembly and said default plug assembly latch together when fully joined.

6. The assembly of claim 5 wherein said secondary plug assembly further includes a latch and wherein said default plug assembly includes a catch and wherein said secondary plug assembly and said default plug assembly latch together via said latch and said catch.

7. An electrical plug assembly, comprising a) a casing having a recess;

b) a default plug assembly including a plurality of default prongs, said default plug assembly rotatably mounted to said casing and moveable into said recess;

c) a secondary plug assembly selectively attachable to said default prongs and rotatable with said default plug assembly when attached thereto; said secondary plug assembly having a main body;

d) said main body of said secondary plug assembly moveable into said recess when attached to said default plug assembly.

8. The assembly of claim 7 wherein said secondary plug assembly includes a plurality of secondary prongs having a different configuration than said default prongs.

9. The assembly of claim 8 wherein said secondary plug assembly includes a plurality of bridging contacts connected to said secondary prongs and adapted to slidably receive said default prongs.

10. The assembly of claim 7 wherein said casing further includes an electrical circuit in selective communication with said default prongs and adapted to condition power received at said default prongs.

11. The assembly of claim 7 wherein said secondary plug assembly and said default plug assembly latch together when fully joined.

12. The assembly of claim 11 wherein said secondary plug assembly further includes a latch and wherein said default plug assembly includes a catch and wherein said secondary plug assembly and said default plug assembly latch together via said latch and said catch.

13. An electrical plug assembly, comprising a) a casing;

b) a default plug assembly rotatably mounted to said casing, said default plug assembly having a plurality of default prongs rotatable with respect to said casing between a storage position and a deployed position;

c) a distinct secondary plug assembly having a main body and a plurality of secondary prongs, said secondary plug assembly repeatably removably attachable to said default prongs and rotatable with said default plug assembly when attached thereto;

d) said casing including a recess proximate said default plug assembly and adapted to receive said default prongs in said storage position;

e) wherein, with said secondary plug assembly attached to said default prongs, said main body lies substantially within said recess when said default prongs assume said storage position.

14. The assembly of claim 13 wherein said secondary plug assembly includes a plurality of secondary prongs having a different configuration than said default prongs.

15. The assembly of claim 13 wherein said secondary plug assembly includes a plurality of bridging contacts connected to said secondary prongs and adapted to slidably receive said default prongs.

16. The assembly of claim 13 wherein said casing further includes an electrical circuit in selective communication with said default prongs and adapted to condition power received at said default prongs.

17. The assembly of claim 13 wherein said secondary plug assembly and said default plug assembly latch together when fully joined.

18. The assembly of claim 17 wherein said secondary plug assembly further includes a latch and wherein said default plug assembly includes a catch and wherein said secondary plug assembly and said default plug assembly latch together via said latch and said catch.

* * * * *